US011192739B2

(12) United States Patent
Van De Sande et al.

(10) Patent No.: US 11,192,739 B2
(45) Date of Patent: Dec. 7, 2021

(54) PAPER PATH STRUCTURE, STACKER, PRINTER AND METHOD FOR OPERATING A PAPER PATH STRUCTURE

(71) Applicant: Océ Holding B.V., Venlo (NL)

(72) Inventors: Henricus J. A. Van De Sande, Venlo (NL); Peter G. La Vos, Venlo (NL); Kevin H. J. R. Prinsen, Venlo (NL); Jacobus M. G. Eijssen, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 221 days.

(21) Appl. No.: 16/452,241

(22) Filed: Jun. 25, 2019

(65) Prior Publication Data

US 2020/0010298 A1 Jan. 9, 2020

(30) Foreign Application Priority Data

Jul. 3, 2018 (EP) ..... 18181318

(51) Int. Cl.

| | |
|---|---|
| ***B65H 29/60*** | (2006.01) |
| ***B65H 15/00*** | (2006.01) |
| ***B65H 5/26*** | (2006.01) |
| ***B65H 29/22*** | (2006.01) |

(52) U.S. Cl.

CPC ..... *B65H 5/26* (2013.01); *B65H 15/004* (2020.08); *B65H 29/22* (2013.01); *B65H 29/60* (2013.01);

(Continued)

(58) Field of Classification Search

CPC ..... B65H 29/60; B65H 29/22; B65H 29/58; B65H 29/40; B65H 15/00; B65H 2301/33;

(Continued)

(56) References Cited

U.S. PATENT DOCUMENTS

| | | | | |
|---|---|---|---|---|
| 4,712,785 | A | 12/1987 | Stemmle | |
| 6,883,800 | B2 * | 4/2005 | Mizuno | B65H 5/34 271/270 |
| 7,566,055 | B2 * | 7/2009 | Spencer | B65H 29/60 271/301 |

(Continued)

FOREIGN PATENT DOCUMENTS

| | | |
|---|---|---|
| EP | 0 807 863 A2 | 11/1997 |
| EP | 1 213 624 B1 | 6/2006 |

(Continued)

OTHER PUBLICATIONS

Search Report issued in European priority U.S. Appl. No. 18/181,318, dated Dec. 19, 2018.

*Primary Examiner* — Luis A Gonzalez

(74) *Attorney, Agent, or Firm* — Birch, Stewart, Kolasch & Birch, LLP

(57) ABSTRACT

The invention provides a paper path structure that is able to perform the following four functions: pass a sheet of paper through the paper path structure with is original orientation maintained; pass a sheet of paper through the paper path structure with its original orientation reversed; stack a sheet of paper in a stack repository with its original orientation maintained; and stack a sheet of paper in the stack repository with its original orientation reversed. The invention also provides a method to operate said paper path structure as well as a stacker and a printer comprising said paper path structure.

18 Claims, 6 Drawing Sheets

(52) U.S. Cl.
CPC .. *B65H 2301/33* (2013.01); *B65H 2301/4212* (2013.01); *B65H 2301/44822* (2013.01); *B65H 2801/06* (2013.01)

(58) Field of Classification Search
CPC .. B65H 2301/3331; B65H 2301/33312; B65H 2301/44822; B65H 2301/332; B65H 2301/133; B65H 2404/651; B65H 2404/63; B65H 15/004; B65H 2801/06
See application file for complete search history.

(56) References Cited

U.S. PATENT DOCUMENTS

| | | | | |
|---|---|---|---|---|
| 2002/0070497 | A1* | 6/2002 | Morrison | B65H 29/12 271/186 |
| 2005/0280198 | A1* | 12/2005 | Laluk | B65H 29/40 271/94 |
| 2006/0251453 | A1* | 11/2006 | Miyake | G03G 15/234 399/401 |
| 2008/0265501 | A1 | 10/2008 | Foote | |
| 2009/0085281 | A1* | 4/2009 | Milillo | B65H 39/10 271/187 |
| 2010/0042252 | A1* | 2/2010 | Moore | B65H 29/60 700/228 |

FOREIGN PATENT DOCUMENTS

| | | | |
|---|---|---|---|
| EP | 2 724 963 | A1 | 4/2014 |
| FR | 2 760 733 | A1 | 9/1998 |

* cited by examiner

PAPER PATH STRUCTURE, STACKER, PRINTER AND METHOD FOR OPERATING A PAPER PATH STRUCTURE

FIELD OF THE INVENTION

The present invention relates to a paper path structure, in particular to a paper path structure for a printer or for a stacker that can be combined with a printer. The invention also relates to a stacker comprising a paper path structure and to a printer comprising a paper path structure. Furthermore, the invention relates to a method for operating a paper path structure.

BACKGROUND ART

Imaging devices, in particular printers, produce their output at a faster and faster rate with each new generation. The output, in particular sheets of paper marked with ink, or, in other words, printed paper, usually needs to be sorted and/or stacked at a high rate. At the same time, office and factory space is usually at a premium and it is therefore strived for compact devices.

In addition, it is often desired to be able to invert (or: "flip") printed sheets, i.e., to receive a paper with its front side in a first orientation (for example, front-side up) and to output the same printed sheet having the reversed orientation (e. g. front-side down).

In EP 1 213 624 A2 a sheet inverter system for a copier or a printer is described.

SUMMARY OF THE INVENTION

It is one of the objects of the present invention to provide a paper path structure, for example for use in a printer or a stacker, which offers a larger range of functions and which nevertheless requires comparatively little space.

According to a first aspect, the invention provides a paper path structure comprising:

an input path section for receiving sheets of paper into the paper path structure;

an output path section for outputting sheets of paper from the paper path structure;

a stack repository for storing a stack of sheets of paper;

a flipping device configured for depositing sheets of paper in the stack repository;

a first path section controllable to convey sheets of paper to the flipping device;

a second path section connected to the input path section and configured to transport sheets of paper to the first path section;

a third path section controllable to transport a sheet of paper to the first path section independently from the input path section;

wherein the first path section is also controllable to transport sheets of paper to the third path section and wherein the third path section is also controllable to receive sheets of paper from the first path section and to transport the received sheet of paper away from the first path section.

The flipping device is a structure that is configured flip a sheet of paper, such that the orientation of the sheet is reversed. Thereby the front and back facing sides of the sheet are interchanged. Preferably, the flipping device comprises a flipping wheel provided with recesses configured to receive and hold a leading edge of a sheet, such that the sheet is flipped by a rotation of the flipping wheel.

Flipping a sheet of paper in this context means in particular that an orientation of the sheet of paper is changed in such a way that a side that has been face-down before the flipping is face-up after the flipping and that a side of the sheet of paper that has been face-up before the flipping is face-down after the flipping. Preferably, no further rotations along other axes of the sheet of paper are performed during the flipping.

It should be understood that flipping a sheet of paper does not necessarily mean that a sheet of paper is parallel to the ground before the flipping and parallel to the ground (with the reversed orientation) after the flipping but also may comprise procedures where a sheet of paper that has an angle of less than 90 degrees with respect to the ground is changed into another orientation with an angle of less than 90 degrees to the ground, wherein a side of the sheet of paper that has been pointing at the ground before the flipping is after the flipping pointing away from the ground and vice versa.

The flipping device is, in particular, configured to receive a sheet of paper with a first side of the sheet oriented towards the center of the wheel, to turn while carrying the sheet of paper (for example by exerting a force on the sheet of paper) and to deposit the received sheet of paper with its first side up in a receptacle or another path section of the paper path structure.

Depending on in which angle the sheet has been received an in which angle the sheet will be released from the flipping device, the flipping device may be able to flip the sheet while turning less than 180 degrees, in particular by turning less than 150 degrees.

A path section, as the term is used herein, may in particular comprise guiding elements configured to guide the sheets of paper along a certain geometrical path through the path section, for example passive rollers that are not driven and/or active rollers that are driven and are configured to actively move the sheets of paper coming into contact with the active rollers as well as other elements known in the prior art, e.g. for bending sheets and/or for adjusting directions of movement of sheet such as guiding sheets into one of a plurality of branches at a fork.

In an embodiment, the paper path structure is configured to:

a) transport a sheet from the input path section via the second paper path section to the flipping device, such that the sheet is stacked in an orientation flipped with respect to said sheet's orientation on the input path section;

b) transport a sheet from the input path section via consecutively the second and third paper path sections to the output path section, such that said sheet is output to the output path section in an orientation flipped with respect to said sheet's orientation on the input path section;

c) transport a sheet from the input path section to the output path section via a fifth paper path section which bypasses the second and third paper path sections, such that said sheet is output to the output path section in the same orientation with respect to said sheet's orientation on the input path section; and d) transport a sheet from the input path section via consecutively the fifth and third paper path sections to the flipping device, such that said sheet is stacked in the same orientation with respect to said sheet's orientation on the input path section.

Orientation of the sheet is herein defined by the two faces of the sheet. A flipped orientation implies that the first face of the sheet faces in the direction, wherein in prior to flipping the second face of the sheet was facing. The paper structure according to the present invention allows sheet to be stacked or output in any desired orientation.

In another embodiment, in step b) the sheet moves from the second paper path section to the third paper path section via the first paper path section, wherein the transport direction of the sheet is reversed on the first paper path section. By reversing the direction of the sheet, the leading and trailing edges of the sheet are exchanged. Preferably, a curvature is provided between the first and second and/or between the first and third paper path sections, such that a first face of the sheet on the second paper path is oriented substantially oppositely to the orientation of a second face of the sheet on the third paper path section. A sheet is herein considered to have two only faces, for example a front page/side and a back page/side. An opposite orientation is herein considered to be with respect to the transport direction on the respective paper path section, as the second and third paper path sections may be provided at an angle with respect to one another. Basically with respect to the direction of gravity the faces of the sheet are exchanged as the sheet passes through the curvature. The curvature may be partially distributed between or over the different paper path sections, as long as the cumulative curvature is sufficient to achieve the sheet flipping effect. The assembly of the paper path sections thus forms one or more flipping devices, which flipping devices can be selectively used to orient a sheet in desired orientation.

In a further embodiment, a first switch assembly is provided at an intersection between the first, second, and third paper path sections, which first switch assembly is configured to selectively direct sheets:

from the second paper path section to the first paper path section in step a);

from the first paper path section to the third paper path section in step b); and from the third paper path section to the first paper path section in step d).

In another embodiment, in step b) the paper path structure is configured such that the sheet moves from the second paper path section to the third paper path section via the first paper path section, wherein the transport direction of the sheet is reversed on the first paper path section. By reversing the direction of the sheet, the sheet is effectively flipped.

In another embodiment, in step d) the paper path structure is configured such that wherein the transport direction of the sheet is reversed on the output paper path section. Specifically, the output paper path section may have a fourth paper section position to receive sheets from the third and fifth paper path sections. The fourth paper path section transports these sheets to the remainder of the output path section.

In a further embodiment, a second switch assembly is provided at an intersection between the output, third, and fifth paper path sections, which second switch assembly is configured to selectively direct sheets:

from the third paper path section to the output paper path section in step b);

from the fifth paper path section to the output paper path section in step c) and d); and from the output path section to the third paper path section in step d).

In another embodiment, a third switch assembly is provided at an intersection between the input, second, and fifth paper path sections, which third switch assembly is configured to selectively direct sheets:

from the input paper path section to the second paper path section in step a) and b);

from the input paper path section to the fifth paper path section in step c) and d).

Preferably, either the second or the third path sections (more preferably the third path section) is a curved path section curved in such a way that when a sheet of paper travels along that curved path section, it is thereby flipped. It is also preferred that the other one of the second and third paths sections, which is not curved in that way, is arranged as a straight line.

Preferably, the curved path section is configured with a bend of at least sixty degrees) (60°), more preferably of at least ninety degrees (90°) such that the sheets of paper transported by the third path section in either direction are automatically flipped.

The invention further provides, according to a second aspect, a stacker comprising a paper path structure according to the first aspect. The stacker may, in particular, be configured to be connected to a printer for receiving printed sheets from the printer and stacking them.

The invention further provides, according to a third aspect, a printer comprising a paper path structure according to the first aspect.

The invention further provides, according to a fourth aspect, a method for operating a paper path structure according to the first aspect, comprising receiving, by the input path section, a sheet of paper having an original orientation of its front side is into the paper path structure; and wherein, when a sheet of paper is to be stacked with a reversed orientation, following steps are performed:

transporting the sheet of paper via the input path section, the second path section and the first path section to the flipping device;

flipping, by the flipping device, the sheet of paper; and depositing, by the flipping device, the sheet of paper in the stack repository such that the sheet of paper is stacked with the reversed orientation.

Variants and modifications will be apparent from the subject-matter of the dependent claims as well as from the description and the corresponding figures.

In some advantageous embodiments, the paper path structure comprises a fourth path section controllable to transport sheets of paper to the third path section. The fourth path section is preferably also controllable to receive sheets of paper from the third path section and to transport the received sheets of paper to the output path section. In other words, the fourth path section may be configured to transport sheets of paper bi-directionally and may be connected between the third path section and the output path section.

In some advantageous embodiments, the paper path structure comprises a fifth path section connected to the input path section and configured to transport sheets of paper away from the input path section. A switch may be provided at an end of the first path section, the switch being controllable to guide sheets of paper from the input path section either into the first path section or into the fifth path section. The paper path structure may comprise a controller for controlling the controllable switch and/or may comprise an interface for receiving a control signal for controlling the controllable switch accordingly.

The fifth path section may be configured to transport sheets of paper to the fourth path section independently from the second and the third path sections. Preferably, the fifth path section may be connected between the input path section and the fourth path section. At an end of the fourth path section that is orientated towards the input path section, a fork may be provided such that both the third path section and the fifth path section are able to transport sheets of paper into the fourth path section. However, preferably, the fork at the end of the fourth path section is configured to only transport sheets from the fourth path section into the third path section and not into the fifth path section. The fifth path section is preferably configured as a one-directional path section.

Preferably, the input path section and the fifth path section are arranged along a straight line. More preferably, also the fourth path section is arranged the same straight line.

In some advantageous embodiments, the second path section, the third path section and the fifth path section form a triangular shape, wherein three forks are provided, each of which forks connects two neighboring of said path sections such that the forks form corners of the triangular shape.

Preferably, the triangular shape comprises two forks with three branches each, wherein each of said two forks allow sheets of paper to be transported from two branches of the fork into a third branch of the fork but allows sheets of paper from that third branch of the fork to be transported into only one fixed branch of the other two branches of the fork.

Preferably, apart from said two forks the triangular shape comprises the switch between the input path section and the second and the fifth path sections, said switch being a three-branched fork which allows transport of a sheet of paper from a first branch (connected to the input path section) to each of the second and the fifth path section (via second and third branches of the fork) but no transport of sheets of paper from either the second or fifth path section into the input path section.

In some advantageous embodiments, the paper path structure comprises a sheet registration unit arranged at the input path section, preferably at an end of the input path section, for example, immediately before the switch. The sheet registration unit may be configured to determine a property of the sheets of paper received by the input path section. Said property may consist of, or comprise, simply the fact that a sheet has been received by the input path section, information about a size of the received sheet, information about a thickness of the received sheet, information about a type of the received sheet and/or the like. A controlling of the path sections of the paper path structure for each received sheet of paper to be transported by the path sections may depend on the determined properties of the received sheet of paper. The sheet registration unit is preferably configured to adjust the lateral position, longitudinal position, and/or rotational angle with respect of the transport direction of a sheet. The sheet registration unit in one example comprises a pair of independently driven rollers or wheels. By applying different angular velocities to the rollers when in contact with a sheet, said sheet may be rotated or shifted laterally (i.e. perpendicularly to the transport direction). The sheet registration unit may further accelerate or decelerate a sheet with respect to an upstream or downstream sheet to adjust its relative position in a stream of sheets. As such, sheets can be ordered in straight stacks. Further, jogged sheet stacks may be formed by selectively shifting groups of sheets in the lateral direction.

In some advantageous embodiments, the output path section comprises a plurality of paper outputs and is controllable to guide sheets of paper received by the output path section to any one of the plurality of paper outputs. The output path section may be controlled by a controller of the paper path structure, for example based on signals received by an interface of the paper path structure, which are transmitted to, and transmitted or processed by, the controller of the paper path structure.

In some advantageous embodiments, the flipping device is configured as a double flipping device, that is, as a flipping device having two distinct portions, which are each able to carry, or convey, a sheet of paper to the stack repository. This allows for stacking sheets of paper using the flipping device with doubled speed, as the flipping device needs much less movement (rotation) from stacking position to receiving position.

In some advantageous embodiments of the method according to the fourth aspect of the present invention, when a sheet of paper is to be stacked with its original orientation maintained, following steps are performed: transporting the sheet of paper via the first path section and the fifth path section to the fourth path section; reversing a direction of transporting of the sheet of paper by the fourth path section; transporting the sheet of paper by the fourth path section, the third path section and the first path section to the flipping device, wherein the sheet of paper is flipped for a first time by travelling along the third path section; flipping, by the flipping device, the sheet of paper for a second time; and depositing, by the flipping device, the sheet of paper in the stack repository such that the sheet of paper is stacked in the stack repository with its original orientation. Using this method, a paper path structure is able to stack sheets of paper with their original orientation maintained.

In some advantageous embodiments of the method, when a sheet of paper is to be passed through the paper path structure so as to have a reversed orientation, following steps are performed: transporting the sheet of paper via the input path section and the second path section to the first path section; reversing a direction of transporting of the sheet of paper by the first path section; transporting the sheet of paper via the first path section, the third path section, whereby the sheet of paper is flipped, and the fourth path section to the output path section; and outputting the sheet of paper by the output path section. Using this method, a sheet of paper may be passed through the paper path structure so as to have a reversed orientation (i.e. face-down if it has been received as face-up by the input path section and vice versa). The flipping device is inactive when the sheet moves over the first path section for being reversed thereon. Longer sheets can also be conveniently flipped in this manner as there is sufficient room in the flipping volume above the sheet stack at the flipping device. As such, the paper path structure can be compact while still able to handle of sheets, resulting in a versatile system.

In some advantageous embodiments of the method, when a sheet of paper is to be passed through the paper path structure with its original orientation maintained, following step are performed: transporting, preferably in a straight line, the sheet of paper via the input path section, the fifth path section and the fourth path section to the output path section; and outputting the sheet of paper by the output path section. Using this embodiment, the paper path structure may pass the sheet of paper through with its original orientation maintained.

BRIEF DESCRIPTION OF THE DRAWINGS

The present invention will become more fully understood from the detailed description given hereinbelow and the accompanying schematic drawings which are given by way of illustration only, and thus are not limitative of the present invention, and wherein.

DETAILED DESCRIPTION OF THE DRAWINGS

Figure 1:
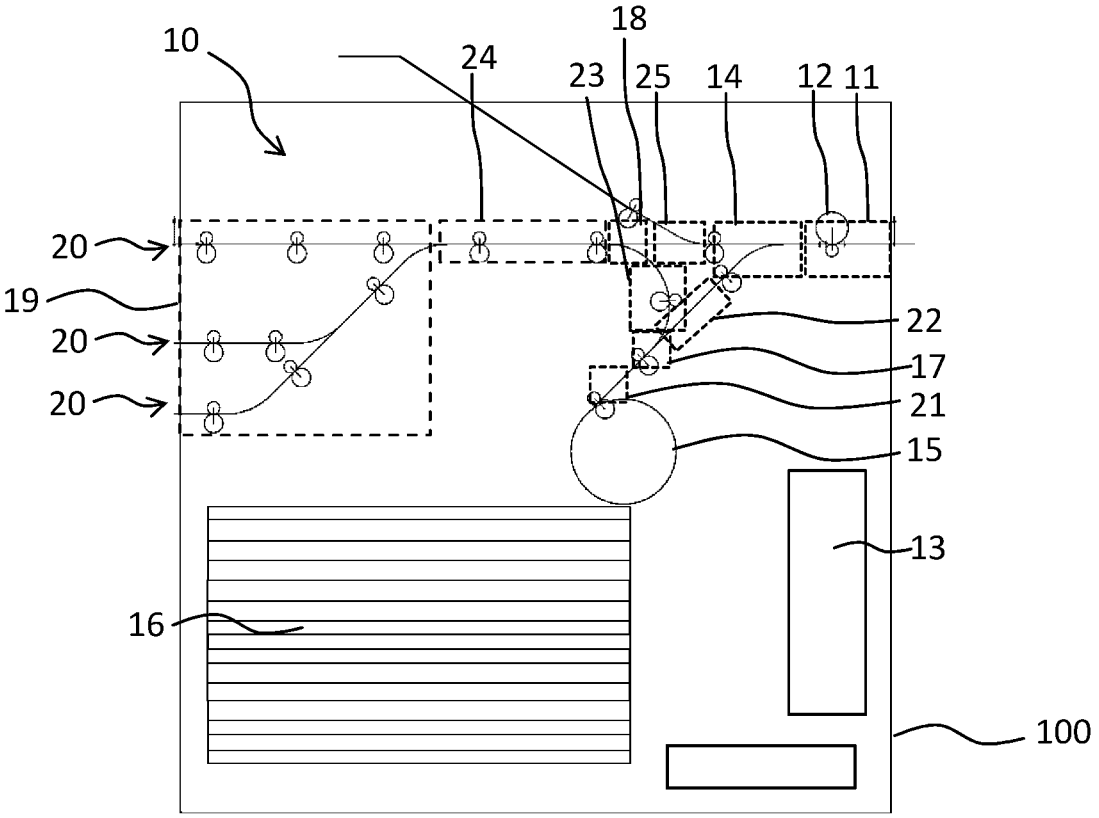
FIG. 1 shows a schematic diagram of a paper path structure according to an embodiment of the first aspect of the present invention as well as a printer or stacker according to embodiments of the second and third aspect of the present invention.

The present invention will now be described with reference to the accompanying drawings, wherein the same reference numerals have been used to identify the same or similar elements throughout the several views, and in some instances throughout the several embodiments.

FIG. 1 shows a schematic diagram of a paper path structure 10 according to an embodiment of the first aspect of the present invention as well as a printer or stacker 100 according to embodiments of the second and third aspect of the present invention.

The paper path structure 10 comprises an input section 11 configured for receiving sheets of paper into the paper path structure 10. For example, the input path section 11 may be part of a printer wherein the input path section 11 may be arranged to receive sheets of paper printed by the printer 100. If the paper path structure 10 is part of a stacker 100, the stacker 100 being configured to be connected to an external printer, the input path section 11 may be advantageously arranged at an outer surface of the stacker 100 such that the input path section 11 may receive printed sheets of paper from the printer into the stacker 100.

Arranged at the input path section 11, a registration unit 12 is arranged, which is configured to determine a property of the sheets of paper received by the input path section 11. The sheet registration unit is configured to adjust the lateral position of the sheet by moving the sheet perpendicular to the transport direction, to rotate the sheet around an axis perpendicular to the plane of the sheet, and/or adjust the relative position of the sheet in the transport direction with respect to a leading or trailing sheet by momentarily adjusting the velocity by which the sheet travels in the transport direction. In one example, the sheet registration unit comprises two registration wheels which can be driven at different or the same velocities to adjust the sheet's position.

The sheet registration unit 12 may be configured to determine a property of the sheets of paper received by the input path section 11. Said property may consist of, or comprise, simply the fact that a sheet has been received by the input path section 11, information about a size of the received sheet, information about a thickness of the received sheet, information about a type of the received sheet and/or the like. A controlling of the path sections of the paper path structure 10 for each received sheet of paper to be transported by the path sections may depend on the determined properties of the received sheet of paper.

The sheet registration unit 12 may be realized in hardware, such as a circuit or a printed circuit board and/or comprising transistors, logic gates and other circuitry as well as sensors such as optical and/or pressure sensors. Additionally, the sheet registration unit 12 may be partially realized in terms of software. Accordingly, the sheet registration unit 12 may comprise, or be operatively coupled to, a processor and a memory storing a software or a firmware that is executed by the processor to perform the functions of the sheet registration unit 12, e.g. to evaluate signals from the sensors of the sheet registration unit 12. Signals may be received by an input interface of the sheet registration unit 12 and signals that the processor of the sheet registration unit 12 creates may be outputted by an output interface of the sheet registration unit 12. The sheet registration unit 12 may be implemented partially as a microcontroller, an ASIC, an FPGA and so on.

The paper path structure 10 may comprise a controller 13 configured to control the operation of the paper path structure 10. In particular, the controlling by the controller 13 may be based on the properties determined of the received sheets of paper by the sheet registration unit 12. The input path section 11 is connected to a switch 14 to which the input path section 11 transports the received sheets of paper and into which the input path section 11 is configured to feed the received sheets of paper. The switch 14 is configured as a first fork with three branches in total, a first branch being connected to the input path section 11 and the switch 14 being controllable to transfer the sheets of paper received from the input path section 11 either to the second or the third branch of the switch 14. The switch 14 may be controlled by the controller 13.

The paper path structure 10 further comprises a flipping device 15, preferably a double flipping device. The flipping device 15 is configured for depositing sheets of paper in a stack repository 16 of the paper path structure 10. The stack repository 16 may be integrated into the printer or stacker 100 as indicated in FIG. 1 but may also be arranged outside of any printer or stacker.

A first path section 21, which may also be termed a stacking path section, is arranged and configured to convey sheets of paper, in particular one at a time, to the flipping device 15. The first path section 21 is configured to transport the sheets of paper up to the flipping device 15 and preferably also to transmit, or hand over, the transported sheets of paper to the flipping device 15.

The second branch of the switch 14 is connected to a second path section 22, which is configured to transport sheets of paper from the input path section 11 and via the switch 14 to the first path section 21, in particular for the sheets of paper to be deposited in the stack repository 16 by the flipping device 15. The second path section 22 may also be termed as a connecting path section and is preferably formed in an essentially, or completely, straight line.

Apart from the second path section 22, the paper path structure 10 further comprises a third section 23 that is also configured to transport sheets of paper to the first path section 21, independently of the second path section 22. Accordingly, at one end of the first path section 21, there is a second fork 17 provided: a first branch of the second fork 17 is connected to the first path section 21, a second branch of the second fork 17 is connected to the second path section and a third branch of the second fork 17 is connected to the third path section 23.

In addition, the first path section 21 is also controllable, for example by the controller 13, to transport sheets of paper, via the third branch of the fork 17, to the third path section 23, and the third path section 23 is also controllable, e. g. by the controller 13, to receive sheets of paper from the first path section 21 and to transport the received sheets of paper away from the first path section 21.

The third path section 23 is, as shown in FIG. 1, preferably configured such that sheets of paper being transported by the third path section 23 are automatically flipped due to a curvature of the third path section 23. The curvature of the third path section 23 is preferably larger than sixty degrees (60°), more preferably larger than ninety degrees (90°), even more preferably larger than hundred twenty degrees (120°).

In the presently described embodiment, the third path section 23 is configured to deliver the received sheets of paper to a fourth path section 24.

The fourth path section 24 is controllable, e. g. by the controller 13, to receive the sheets of paper from the third path section 23 and to transport the received sheets of paper to an output path section 19 of the paper path structure 10. The output path section 19 may comprise one paper output 20 or a plurality of paper outputs 20. The output path section 19 may be controllable, e. g. by the controller 13, to guide sheets of paper received by the output path section 19 to anyone of the plurality of paper outputs 20.

In FIG. 1, the fourth path section 24 and the output path section 19 are shown as separate from one another; in some embodiments, the output path section 19 and the fourth path section 24 may be integrated into one another such that, for example, the fourth path section leads, as also shown in FIG. 1, directly to one of the paper outputs 20 of the output path section 19, wherein elements necessary for the reversing of the direction of transporting within the fourth path section 24 may be arranged, for example, close to the paper output 20 at the end of the fourth path section 24.

The fourth path section 24 is also configured to be controllable, by the controller 13, to reverse direction of transporting of sheets of paper such that the fourth path section 24 is able to transport sheets of paper to the third path section 23 and to insert sheets of paper into the third path section 23, in particular for having them deposited, via the first path section 21 and the flipping device 15, in the stack repository 16 of the paper path structure 10. The fourth path section 24 may also be termed as a reversing path section as it is, just as the first path section 21, a path section in which the direction of motion of sheets of paper may be reversed.

Between the third path section 23 and the fourth path section 24, a third fork 18 with again three branches is arranged. A first branch of the third fork 18 is connected to the fourth path section 24. A second branch of the third fork 18 is connected to the third path section 23, and sheets of paper may pass the second branch of the third fork 18 in both directions.

The second fork 17 includes a first switch assembly that is provided at an intersection between the first, second, and third path sections 21, 22, 23, which first switch assembly 17 is configured to selectively direct sheets from the second path section 22 to the first path section 21, from the first path section 21 to the third path section 23, and from the third path 23 section to the first path section 21.

The third fork 18 includes a second switch assembly that is provided at an intersection between the output path section 19, the third path section 23, and the fifth path section 25, which second switch assembly 18 is configured to selectively direct sheets from the third path section 23 to the output path section 19, from the fifth path section 25 to the output path section 19 and from the output path section 19 to the third path section 23.

The switch 14 may be a third switch assembly that is provided at an intersection between the input path section 11, the second path section 22, and the fifth path section 25, which third switch assembly 14 is configured to selectively direct sheets from the input path section 11 to the second path section 22 and from the input path section 11 to the fifth path section 25.

The path section 10 further comprises a fifth path section 25 that may be termed as a bridging section and which connects the third branch of the first fork (switch 14) with the third branch of the third fork 18. The switch 14 is controllable, by the controller 13, to direct sheets of paper received from the input path section 11, via the third branch of the switch 14, into the fifth path section 25. The fifth path section 25 is configured to receive sheets of paper from the switch 14 and to transport them to the third branch of the third fork 18 and from there into the fourth path section 24. In other words, the third fork 18 is configured such that sheets of paper may be transported from its third branch to its first branch, from its second branch to its first branch and from its first branch to its second branch, but in no other way. In a preferred embodiment, the fifth path section 25 comprises a switch assembly 31 for selectively redirecting sheets from the fifth paper path section 25 to a top tray 30, which provides an additional output location for sheets.

Accordingly, the switch 14 is controllable to guide sheets of paper from the input path section 11 into either the second path section 22 or the fifth path section 25, but not in any other direction.

Preferably, the input path section 11, the first path section 21, the second path section 22, the fourth path section 24 and/or the fifth path section 25, more preferably all of them, are provided essentially, or completely, as linear sections, i.e. as comprising essentially no curvature or no curvature at all.

Preferably, the input path section 11 and the fifth path section 25 (and optionally the fourth path section 24) are formed in a straight line.

The second fork 17 is configured such that sheets of paper may be transmitted from its second branch (connected to the second path section 22) to its first branch (connected to the first path section 21), from its third branch (connected to the third path section 23) to its first branch and from its first branch to its third branch, but in no other way.

Accordingly, the second path section 22, the third path section 23 and the fifth path section 25 form a triangular shape, or triangular structure, with the switch 14 and the second fork 17 and the third fork 18 as its corners. Whereas sheets of paper may be transported along the third path section 23 bi-directionally, sheets of paper may only other travel in one direction along the second path section 22 and the fifth path section 25.

The paper path structure 10 as described in the foregoing is advantageously able to provide at least the following four functions:

- stacking a sheet of paper in the stack repository 16 with a reversed orientation as compared to an orientation, in which the sheet of paper is received by the input path section;
- stacking a sheet of paper with its original orientation maintained;
- passing a sheet of paper through the paper path structure 10 with a reversed orientation as compared to the original orientation;
- passing a sheet of paper through the paper path structure 10 (i.e. outputting the sheet of paper) with its original orientation maintained.

Methods of operating the paper path structure of the first aspect of the present invention will be described in the following with respect to FIG. 2 as well as with respect to FIGS. 3 to 6.

Figure 2:
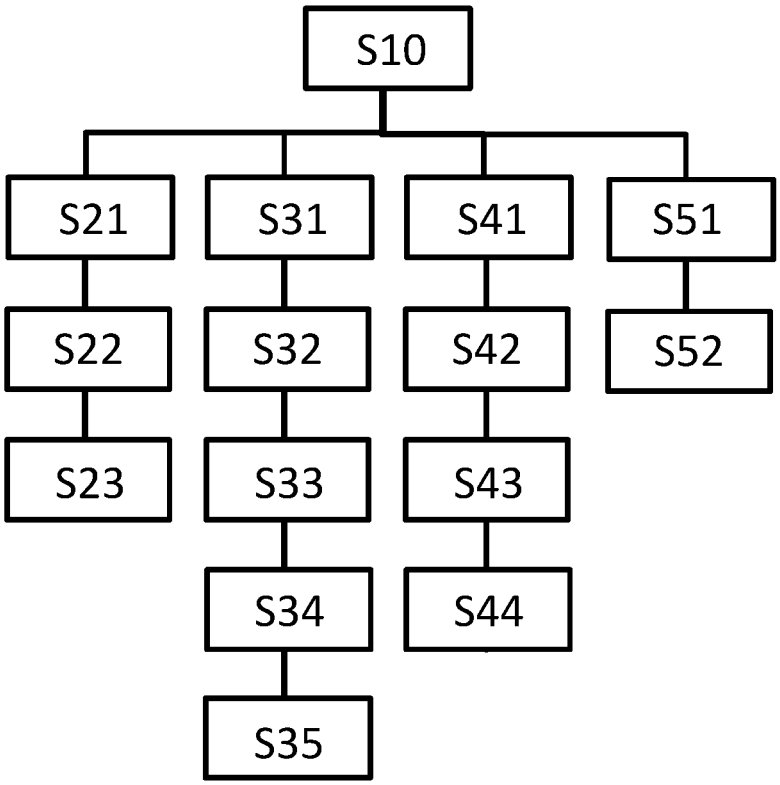
FIG. 2 shows a schematic flow diagram illustrating embodiments of the method according to the fourth aspect of the present invention.

FIG. 2 shows a schematic flow diagram illustrating embodiments of the method according to the fourth aspect of the present invention.

FIG. 3 to FIG. 6 illustrate various functions of the paper path structure 10 as well as several variants, or ways to utilize, the method according to the fourth aspect of the present invention.

In a step S10, a sheet of paper is received by the input path section 11.

The orientation, which a front side of the received sheet of paper has when it is received by the input path section 11 will be called the "original orientation" in the following. For example, when a printed side of the sheet of paper is face-up when the sheet of paper is received by the input path section 11, the original orientation is face-up and the reversed orientation would be face-down.

When a sheet of paper is to be stacked with a reversed orientation, the following steps are performed:

In a step S21, the sheet of paper received via the input path section 11 is transported via the input path section 11, the switch 14, the second path section 22 and the first path section 21 to the flipping device.

In a step S22, the sheet of paper is flipped by the flipping device 15.

In a step S23, the flipped sheet of paper is deposited, by the flipping device 15, into the stack repository 16 with the reversed orientation.

Figure 3:
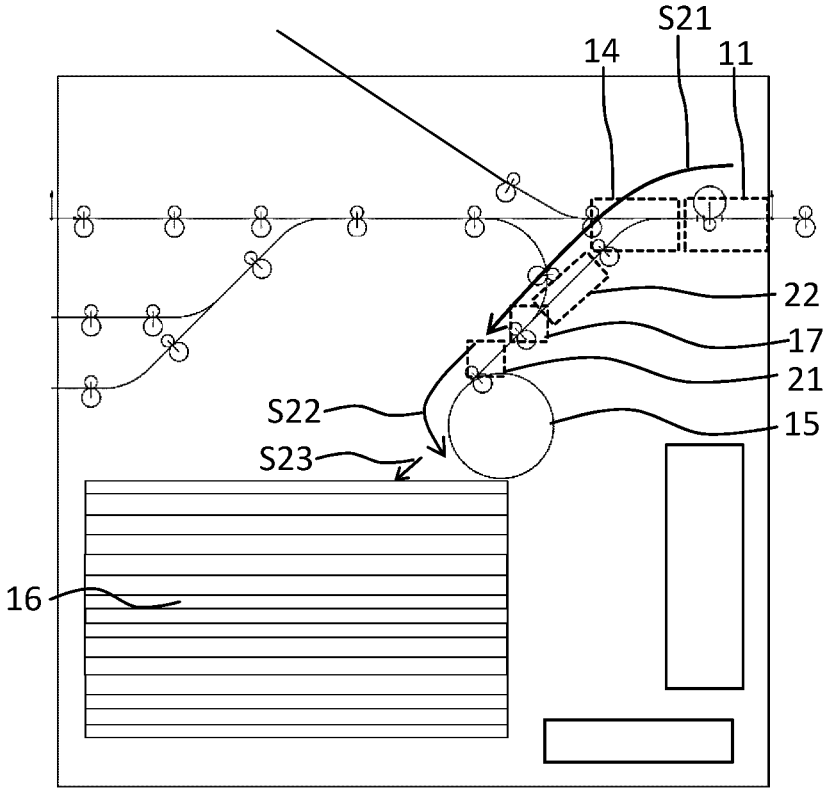
FIG. 3 to FIG. 6 illustrate various functions of the paper path structure according to the first aspect as well as several variants, or ways to utilize, the method according to the fourth aspect of the present invention.

The method steps S21, S22 and S23 are illustrated in FIG. 3.

In case that a sheet of paper received by the input path section 11 is to be stacked with its original orientation maintained, the following steps are performed:

In a step S31, the sheet of paper is transported via the first path section 11, the switch 14, the fifth path section 25 and the third fork 18 to the fourth path section 24, preferably in a straight line.

In a step S32, a direction of transporting of the sheet of paper is reversed by the fourth path section 24.

In a step S33, the sheet of paper is transported via the fourth path section 24, the first and second branches of the third fork 18, the third path section 23, the third and first branches of the second fork 17 and the first path section 21 to the flipping device 15. In step S34, the sheet of paper is flipped for a first time by a curvature of the third path section 23 and arrives flipped at the flipping device 15.

In a step S34, the sheet of paper received from the third path section 23 is flipped for a second time by the flipping device 15 and is then, in a step S35, deposited by the flipping device 15 in the stack repository 16 such that the sheet of paper is stacked in the stack repository 16 with its original orientation (by virtue of being flipped twice).

Figure 4:
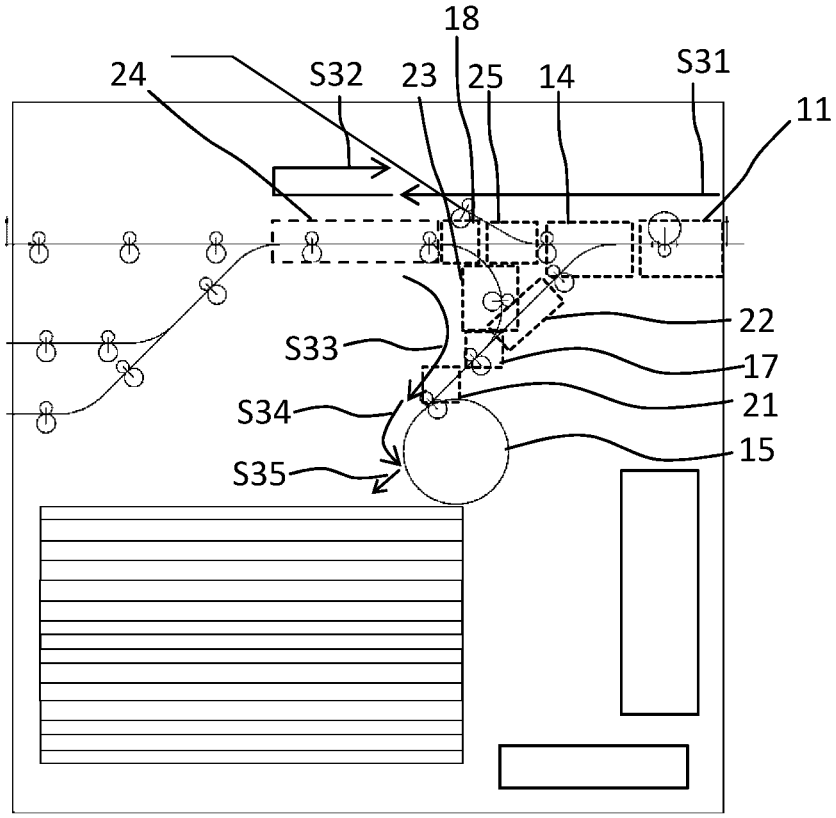

Steps S31 to S35 are illustrated in FIG. 4.

In the case that a sheet of paper is to be passed through the paper path structure 10 so as to have a reversed orientation, the following steps may be performed:

In a step S41, the received sheet of paper is transported via the input path section 11, the switch 14, the second path section 22, the second fork 17 to the first path section 21.

In a step S42, a direction of transporting of the sheet of paper is reversed by the first path section 21.

In a step S43, the sheet of paper is transported via the first path section 21, the second fork 17, a third path section 23, whereby the sheet of paper is flipped due to the curvature of the third path section 23, and the third fork 18 to the fourth path section 24 and from the fourth path section 24 to the output path section 19.

In a step S44, the sheet of paper is output by the output path section 19.

Figure 5:
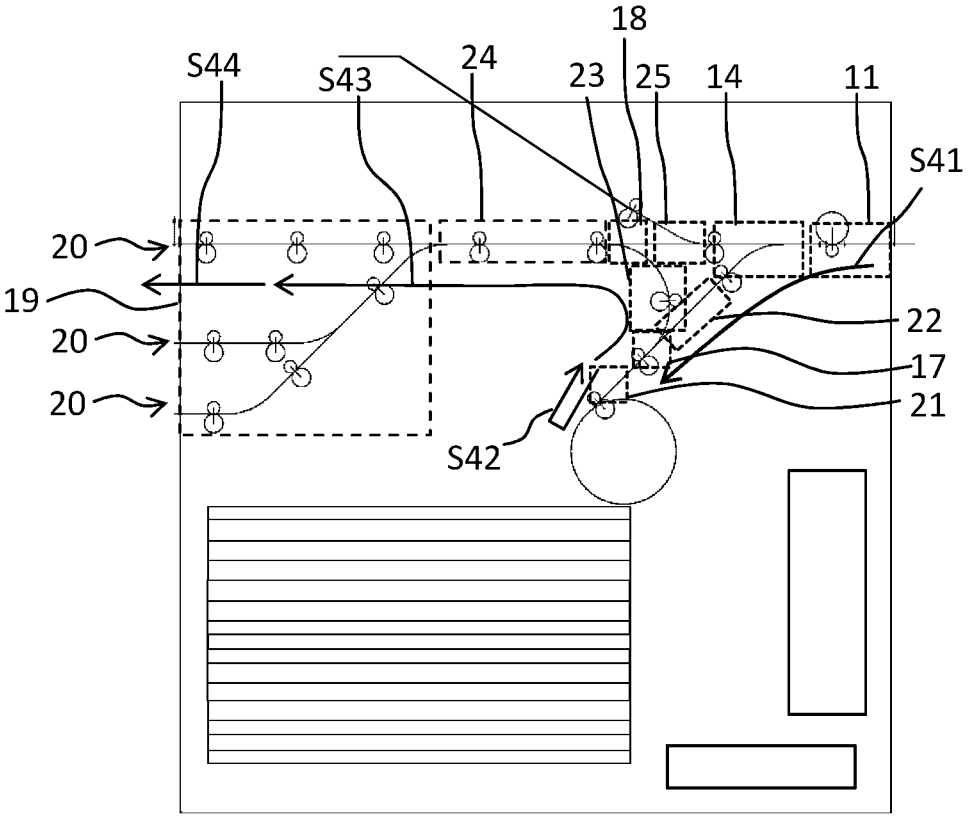

The steps S41, S42, S42 and S44 are illustrated in FIG. 5.

In the case that a sheet of paper is to be passed through the paper path structure 10 with its original orientation maintained, the following steps may be performed:

In a step S51, the received sheet of paper is transported via the input path section 11, the switch 14, a fifth path section 25, the third fork 18 and the fourth path section 24 to the output path section 19.

In a step S52, a sheet of paper is output by the output path section 19.

Figure 6:
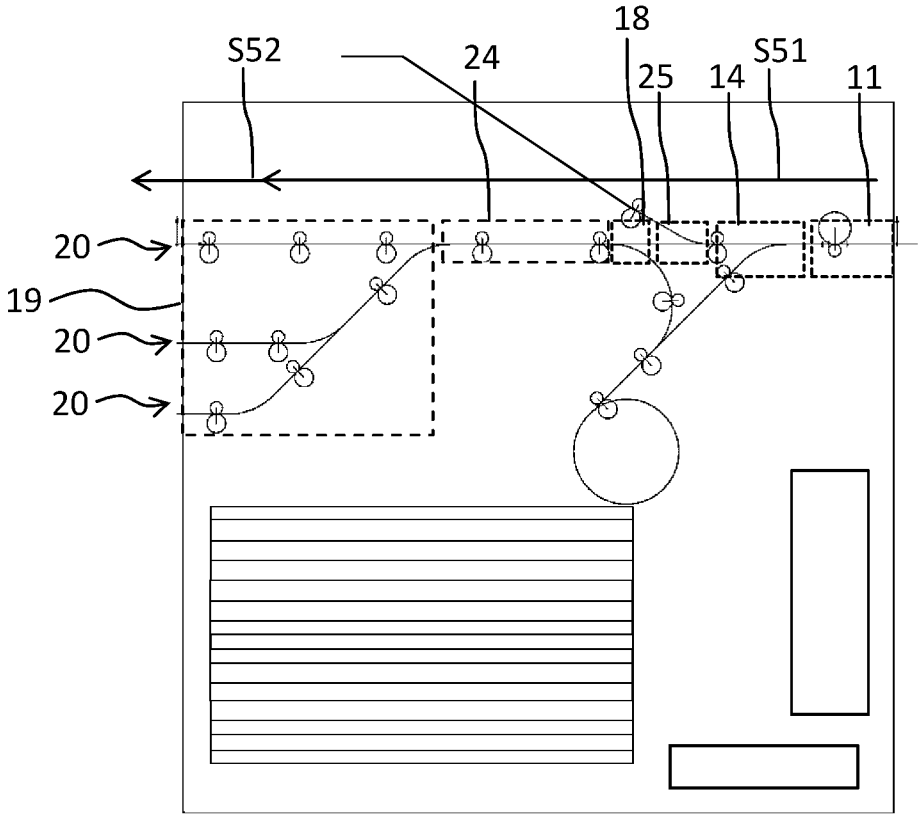

Steps S51 and S52 are illustrated in FIG. 6.

It will be evident that the described embodiments may be varied in many ways. All such modifications as would be evident to one skilled in the art starting from what is explicitly described are intended to be included.

For example, although mostly variants have been discussed in which the third path section is curved in such a way as to flip sheets of paper, and the second path section is arranged as a straight line, it may be conceived that the third path section is arranged as a straight line and the second path section is arranged with a curvature such as to flip sheets of paper being transported by the second path section, and the directions of the forks 14, 17, 18 of the triangle structure formed by the second, third and fifth path sections may be arranged correspondingly.

The invention may be summarized as follows: a paper path structure is provided that is able to perform the following four functions: pass a sheet of paper through the paper path structure with is original orientation maintained; pass a sheet of paper through the paper path structure with its original orientation reversed; stack a sheet of paper in a stack repository with its original orientation maintained; and stack a sheet of paper in the stack repository with its original orientation reversed.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A paper path structure, comprising:

an input path section for receiving sheets of paper into the paper path structure;

an output path section for outputting sheets of paper from the paper path structure;

a stack repository for storing a stack of sheets of paper;

a flipping device configured for depositing sheets of paper in the stack repository;

a first path section controllable to convey sheets of paper to the flipping device;

a second path section connected to the input path section and configured to transport sheets of paper to the first path section;

a third path section controllable to transport a sheet of paper to the first path section independently from the input path section;

wherein the first path section is also controllable to transport sheets of paper to the third path section and wherein the third path section is also controllable to receive sheets of paper from the first path section and to transport the received sheet of paper away from the first path section, wherein the paper path structure is configured to:

a) transport a sheet from the input path section via the second path section to the flipping device, such that the sheet is stacked in an orientation flipped with respect to said sheet's orientation on the input path section;

b) transport a sheet from the input path section via consecutively the second and third path sections to the output path section, such that said sheet is output to the output path section in an orientation flipped with respect to said sheet's orientation on the input path section;

c) transport a sheet from the input path section to the output, path section via a fifth path section which bypasses the second and third path sections, such that said sheet is output to the output path section in the same orientation with respect to said sheet's orientation on the input path section; and d) transport a sheet from the input path section via consecutively the fifth and third path sections to the flipping device, such that said sheet is stacked in the same orientation with respect to said sheet's orientation on the input path section.

2. The paper path structure according to claim 1, further comprising a fourth path section controllable to transport sheets of paper to the third path section;

wherein the fourth path section is also controllable to receive sheets of paper from the third path section and to transport the received sheets of paper to the output path section.

3. The paper path structure according to claim 2, wherein the fifth path section is connected to the input path section and is configured to transport sheets of paper away from the input path section, and wherein the paper path structure further comprises a switch provided at an end of the input path section, the switch being controllable to guide sheets of paper from the input path section into the first path section or into the fifth path section.

4. The paper path structure according to claim 3, wherein the fifth path section is configured to transport sheets of paper to the fourth path section independently from the second and third path sections.

5. The paper path structure according to claim 4, wherein the second path section, the third path section and the fifth path section form a triangular shape.

6. The paper path structure according to claim 5, wherein the triangular shape comprises two forks with three branches each, and wherein at least one of said two forks allows sheets of paper to be transported only from its second branch to its first branch, from its third branch to its first branch or from its first branch to its third branch.

7. The paper path structure according to claim 1, comprising a sheet registration unit arranged at the input path section and configured to determine a property of the sheets of paper received by the input path section, wherein a controlling of the path sections of the paper path structure for each received sheet of paper depends on the determined properties of that received sheet of paper.

8. The paper path structure according to according to claim 1, wherein the output path section comprises a plurality of paper outputs and is controllable to guide sheets of paper received by the output path section to any one of the plurality of paper outputs.

9. The paper path structure according to claim 1, further comprising a controller for controlling the input path section to transport the sheet and for controlling the flipping device, such that:

a) when a sheet is transported from the input path section via the second path section to the flipping device, the flipping device is configured and/or oriented to receive, hold, and flip the sheet;

b) when a sheet is transported from the input path section via consecutively the second and third path sections to the output path section, the flipping device is configured and/or oriented to prevent the flipping device from holding the sheet.

10. The paper path structure according to claim 1, further comprising a first switch assembly provided at an intersection between the first, second, and third path sections, which first switch assembly is configured to selectively direct sheets:

from the second path section to the first path section in step a);

from the first path section to the third path section in step b); and from the third path section to the first path section in step d).

11. The paper path structure according to claim 10, further comprising a second switch assembly provided at an intersection between the output, third, and fifth path sections, which second switch assembly is configured to selectively direct sheets:

from the third path section to the output paper path section in step b);

from the fifth path section to the output path section in step c) and d); and from the output path section to the third path section in step d).

12. The paper path structure according to claim 11, further comprising a third switch assembly provided at an intersection between the input, second, and fifth path sections, which third switch assembly is configured to selectively direct sheets:

from the input path section to the second path section in step a) and b);

from the input path section to the fifth path section in step c) and d).

13. The paper path structure according to claim 1, wherein in step b) the paper path structure is configured such that the sheet moves from the second path section to the third path section via the first path section, wherein the transport direction of the sheet is reversed on the first path section.

14. The paper path structure according to claim 13, wherein in step d) the paper path structure is configured such that a transport direction of the sheet is reversed on the output path section.

15. A stacker comprising a paper path structure according to claim 1.

16. A printer comprising a paper path structure according to claim 1.

17. A method for operating a paper path structure, the paper path structure comprising:

an input path section for receiving sheets of paper into the paper path structure;

an output path section for outputting sheets of paper from the paper path structure;

a stack repository for storing a stack of sheets of paper;

a flipping device configured for depositing sheets of paper in the stack repository;

a first path section controllable to convey sheets of paper to the flipping device:

a second path section connected to the input path section and configured to transport sheets of paper to the first path section;

a third path section controllable to transport a sheet of paper to the first path section independently from the input path section;

wherein the first path section is also controllable to transport sheets of paper to the third path section and wherein the third path section is also controllable to receive sheets of paper from the first path section and to transport the received sheet of paper away from the first path section the method comprising:

receiving, by the input path section, a sheet of paper having an original orientation of its front side is into the paper path structure; and wherein, when a sheet of paper is to be stacked with a reversed orientation, following steps are performed:

transporting the sheet of paper via the input path section, the second path section and the first path section to the flipping device;

flipping, by the flipping device, the sheet of paper; and depositing, by the flipping device, the sheet of paper in the stack repository such that the sheet of paper is stacked with the reversed orientation, wherein, when a sheet of paper is to be stacked with its original orientation maintained, following steps are performed:

transporting the sheet of paper via the first path section and the fifth path section to the fourth path section;

reversing a direction of transporting of the sheet of paper by the fourth path section;

transporting the sheet of paper via the fourth path section, the third path section and the first path section to the flipping device, wherein the sheet of paper is flipped for a first time by travelling along the third path section;

flipping, by the flipping device, the sheet of paper for a second time; and depositing, by the flipping device, the sheet of paper in the stack repository such that the sheet of paper is stacked with its original orientation.

18. The method according to claim 17, wherein, when a sheet of paper is to be passed through the paper path structure so as to have a reversed orientation, following steps are performed:

transporting the sheet of paper via the input path section and the second path section to the first path section;

reversing a direction of transporting of the sheet of paper by the first path section;

transporting the sheet of paper via the first path section, the third path section, whereby the sheet of paper is flipped, and the fourth path section to the output path section; and outputting the sheet of paper by the output path section.

* * * * *